US005268722A

United States Patent [19]

Ikkatai et al.

[11] Patent Number: 5,268,722

[45] Date of Patent: Dec. 7, 1993

[54] DETACHABLE DEVELOPER SUPPLY CONTAINER HAVING MEANS FOR SELECTIVELY PROHIBITING DETACHMENT

[75] Inventors: Masatoshi Ikkatai, Kawasaki; Yutaka Ban, Tokyo; Tomohiro Aoki, Yokohama; Takaji Yonemori, Kawasaki, all of Japan

[73] Assignee: Canon Kabushiki Kaisha, Tokyo, Japan

[21] Appl. No.: 679,094

[22] Filed: Apr. 2, 1991

[30] Foreign Application Priority Data

Apr. 13, 1990 [JP] Japan ..... 2-96182
Apr. 13, 1990 [JP] Japan ..... 2-96183
Apr. 13, 1990 [JP] Japan ..... 2-96184

[51] Int. Cl.[5] ..... G03G 15/06
[52] U.S. Cl. ..... 355/260; 355/245
[58] Field of Search ..... 355/260, 245, 200; 118/644; 222/DIG. 1

[56] References Cited

U.S. PATENT DOCUMENTS 4,491,161 1/1985 Tamura et al. ..... 141/364
4,611,899 9/1986 Kasamura et al. .
4,740,808 4/1988 Kasamura et al. .
4,752,807 6/1988 Mort ..... 355/260
4,937,628 6/1990 Cipolla et al. ..... 355/260
4,942,432 7/1990 Mort et al. ..... 355/260
4,978,995 12/1990 Takahashi ..... 355/260 X
4,981,218 1/1991 Ban et al. ..... 206/633
4,997,016 3/1991 Hacknauer et al. ..... 355/260 X

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

A developer supply device for supplying an image forming apparatus with a developer includes a developer accomodating container having an opening for supplying the developer, and a member for opening and closing the opening of the container. The developer accomodating container is slid to be positioned at a predetermined position. The direction of movement of the openable and closable member to open the opening coincides with the direction of the sliding movement for being positioned. A force needed for the movement of the openable and closable member is arranged to be larger than a force needed for the sliding movement of the developer accomodating container. The device also includes a regulating member, which prevents the developer accomodating container from being moved from the predetermined position when the openable and closable member is opened. In order to prevent mismounting of an improper developer accomodating container, engagement between the developer accomodating container and a mounting portion for the container is arranged to be different in accordance with the kind of the developer.

15 Claims, 12 Drawing Sheets

DETACHABLE DEVELOPER SUPPLY CONTAINER HAVING MEANS FOR SELECTIVELY PROHIBITING DETACHMENT

BACKGROUND OF THE INVENTION

1. Field of the Invention

This invention relates to a developer supply device for supplying a developer for an image forming apparatus, such as an electrophotographic copier, a laser-beam printer or the like.

2. Description of the Related Art

Image forming apparatuses, wherein a developer supply container, serving as a developer accomodating container, is used to supply a dry-type developer (toner), have been known.

There are various kinds of toner supply methods using the developer supply container. In one method, toner is supplied from a toner supply container having a slidably openable cover.

In this method, after positioning the developer supply container at a predetermined supply position of the main body of an image forming apparatus, the slidably openable cover of the developer supply container is opened to supply toner within the container to the side of the main body of the apparatus.

Various methods may be considered for positioning the developer supply container at a predetermined position. A method may, for example, be considered wherein, after mounting the developer supply container at a supply position of the main body of the apparatus, the container is more or less slidalby moved relative to the main body for positioning the container on the main body.

However, in the method wherein the developer supply container is slidably moved relative to the main body of the apparatus to position the container on the main body, and the openable cover is then slid in the same direction and opened to supply toner within the container to the main body, a case may arise wherein the openable cover is opened in a state that the developer supply container is not sufficiently slidably moved relative to the main body, that is, in the state that the container is not properly positioned relative to the main body.

In such a case, since an opening of the main body of the apparatus is not exactly positioned relative to an opening of the developer supply container, toner within the developer supply container adheres to the neighborhood of the opening of the main body, thus staining the main body.

When the developer supply container is detached after supplying toner, it is preferred that the developer supply container can be detached in the state that the openable cover is sufficiently closed from the viewpoint of preventing the scattering of the toner.

SUMMARY OF THE INVENTION

The present invention has been made in consideration of the above-described problems.

It is an object of the present invention to provide a developer supply device which prevents the scattering of a developer.

It is a further object of the present invention to provide a developer supply device which can securely position a developer supply container.

It is a still further object of the present invention to provide a developer supply device, wherein a developer supply container cannot be detached from its mounting position in the state that an opening of the developer supply container is opened.

It is still another object of the present invention to provide a developer supply device which prevent mismounting of an unsuitable developer supply container.

These and other objects and features of the present invention will become more apparent from the following detained description taken in connection with the accompanying drawings.

According to one aspect of the invention, a developer supply device is provided with a container for accomodating a developer, the container having an opening for supplying the developer. A cover opens and closes the opening, and a means is provided for slidably moving the container in a first direction to set the container at a predetermined position. The cover moves in the first predetermined direction when opening the opening, and a force required to move the cover when opening the opening is larger than a force required to move the container to the predetermined position.

According to another aspect of the invention, a member is provided for regulating athe sliding movement of the container. The regulating member engages the cover to regulate the movement of the container from the predetermined position when the container is set at the predetermined position and the cover is positioned to open the opening.

According to still another aspect of the invention, an engaging portion is provided at the cover, the engaging portion being engaged with the member for regulating a movement of the container from the predetermined position.

According to a further aspect of the invention, a developer supply device is provided with a container for accomodating a developer, the container having a polygonal opening for supplying the developer. A cover opens and closes the opening, and a means is provided for slidably moving the container to set the container at a predetermined position. One of projections and recesses is provided at corresponding positions of at least three sides along the polygonal opening for engaging the other of the recesses and projections provided at a side on which the container is to be mounted, so that the container can be set at the predetermined position.

DETAILED DESCRIPTION OF THE PREFERRED EMBODIMENTS

Preferred embodiments of the present invention will now be explained with reference to the drawings.

Figure 1:
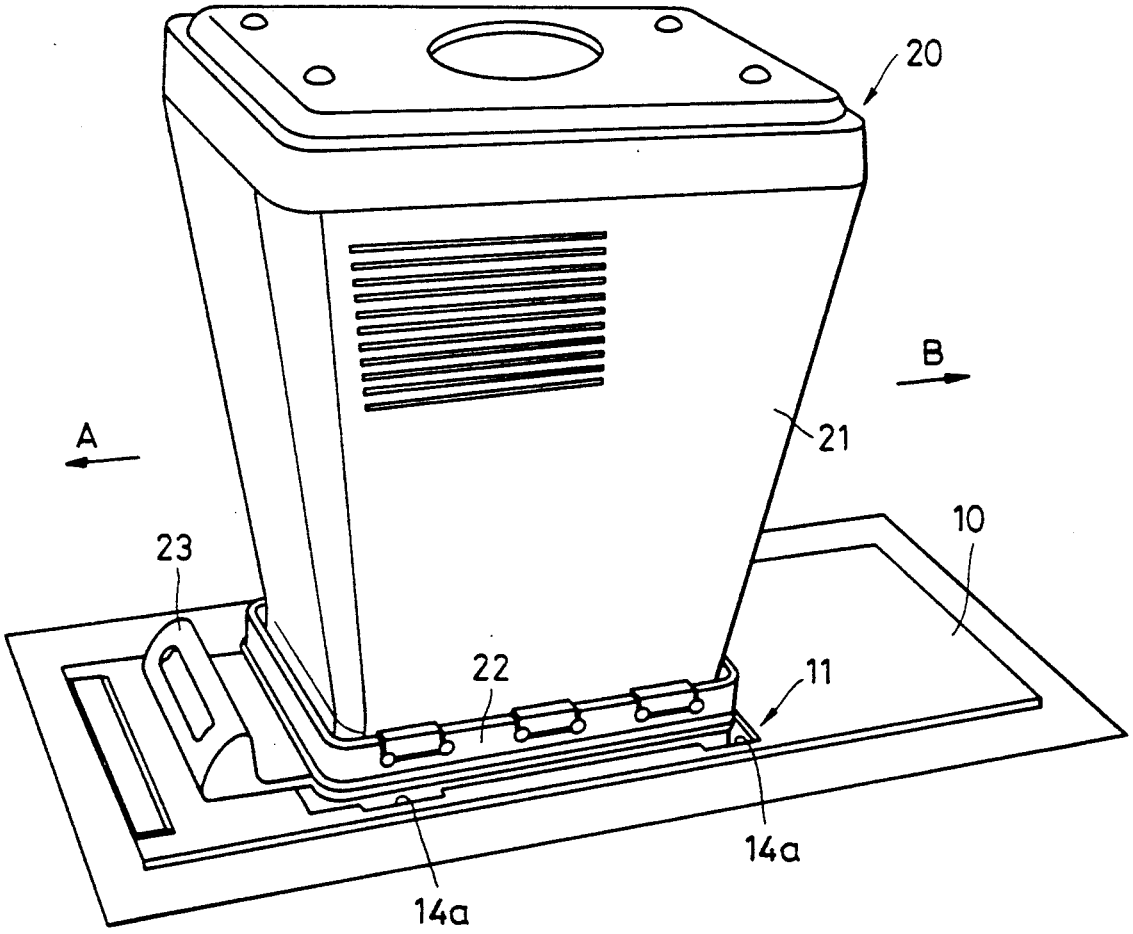
FIG. 1 is a perspective view showing a state wherein a developer supply container is mounted on a container mounting portion of an upper cover of a hopper.

FIG. 1 shows a state wherein a box-like developer supply container (developer accomodating cotainer) 20 having a rectangular cross section is mounted on an upper cover 10 of a toner hopper (a unit to be supplied with toner) of an Image forming apparatus. The developer supply container 20 can supply a developer (toner) within the toner hopper.

Although not specifically illustrated, the image forming apparatus is a well-known electrophotographic image forming apparatus in which respective process units, such as a charger, an optical system, a developing unit, a transfer unit, a cleaning unit and the like, are disposed around a photosensitive drum. Toner is supplied within the developing unit via the above-described toner hopper provided at an upper portion of the developing unit.

When toner is not supplied, a supply port in the upper cover of the hopper is closed with a member (not shown).

Figure 3:
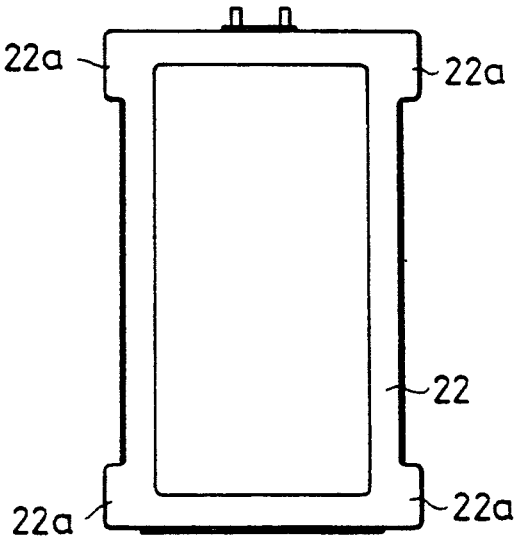
FIG. 3 is a plan view of a guide member of the developer supply container.
Figure 4:
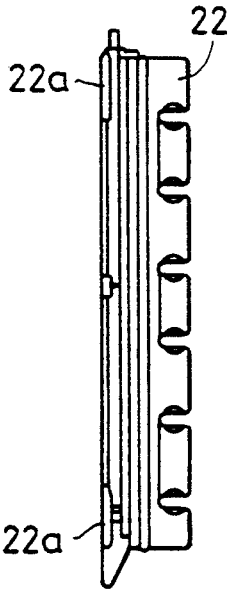
FIG. 4 is a side view of the guide member shown in FIG. 3.

The developer supply container 20 comprises a main body 21 of the container having toner to be supplied therewithin, a guide member 22 surrounding the circumference of an opening 21*a* (see FIG. 2) provided at a lower portion of the main body 21 and having positioning projections 22*a* (see FIG. 3 or FIG. 4) protruding at four corners of its outer circumference. An openable (and closable) cover 23 slidably reciprocates relative to the guide member 22 to open and close the opening 21*a* in the main body 21, and the like.

Figure 2:
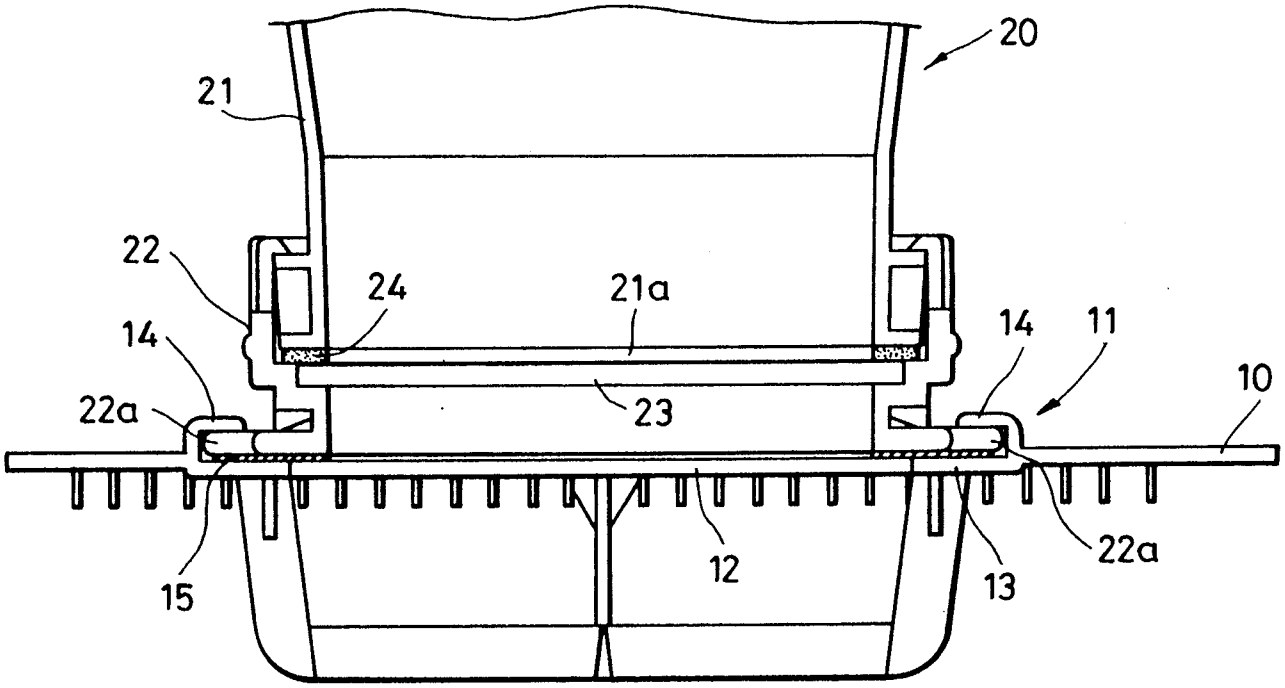
FIG. 2 is a cross-sectional view showing a state wherein the developer supply container is dropped in the container mounting portion of the upper cover of the hopper.
Figure 5:
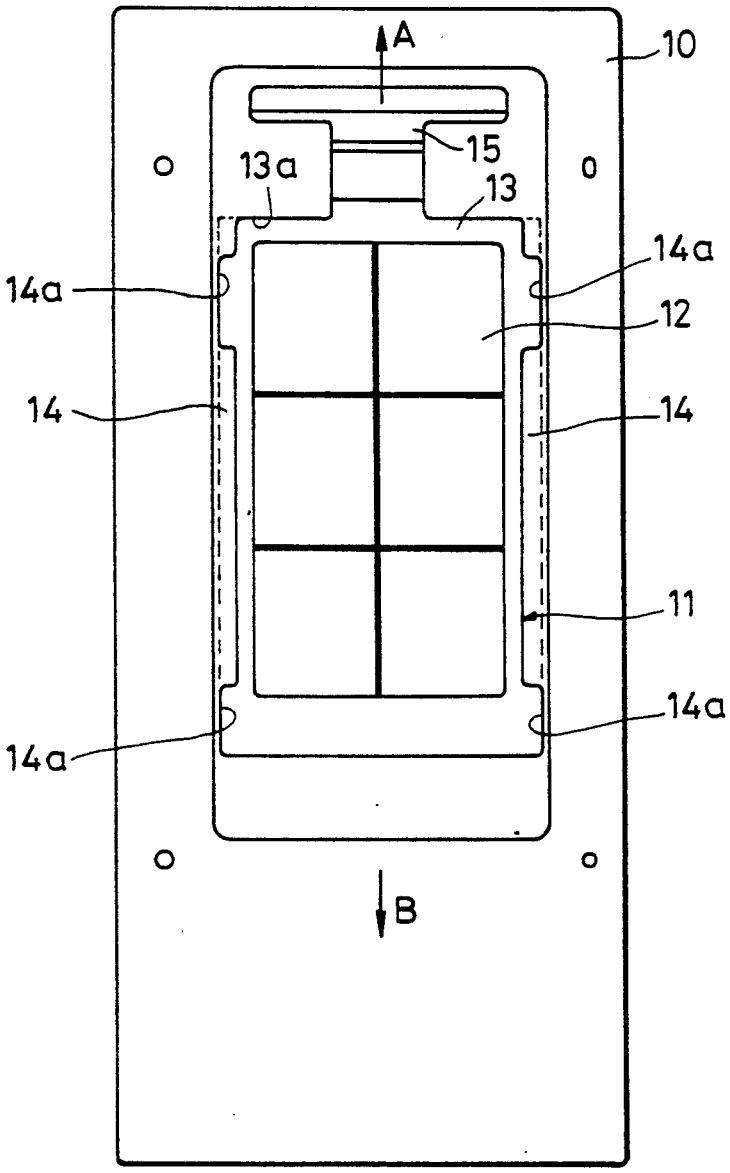
FIG. 5 is a plan view of the neighborhood of the container mounting portion of the upper cover of the hopper.

As shown in FIG. 5, an opening 12 for supplying toner is provided in a portion 11 of the upper cover 10 for mounting the developer supply container 20. Around the opening 12 is provided a mounting member 13 for mounting and sliding the developer supply container 20. On the mounting member 13 is provided a seal member 15 (see FIG. 5), which has a sealing function to prevent the leakage of toner between the developer supply container 20 and the container mounting portion 11. To the right and left surfaces facing each other of the mounting member 13 are mounted L-like guide members 14 for grasping the positioning projections 22*a* of the developer supply container 20 from above, as shown in FIG. 2.

As shown in FIG. 5, front and rear end portions of the guide members 14 are provided with four notches 14*a* having the same shape as the positioning projections 22*a* of the developer supply container 20 and having a somewhat larger size. By vertically aligning the notches 14*a* with the positioning projections 22*a*, the developer supply container 20 is mounted on the mounting member 13 of the container mounting portion 11 of the upper cover 11 of the hopper in a dropped state. By sliding the developer supply container 20 in a forward direction (in a direction A as shown in FIG. 1 or FIG. 5) until the positioning projections 22*a* at the front side of the container 20 contact a positioning end portion 13*a* of the container mounting portion 11 in this state, the opening 12 of the container mounting portion 11 and the opening 21*a* of the developer supply container 20 vertically coincide with each other to position the developer supply container 20 on the upper cover 10 of the hopper.

Figure 6:
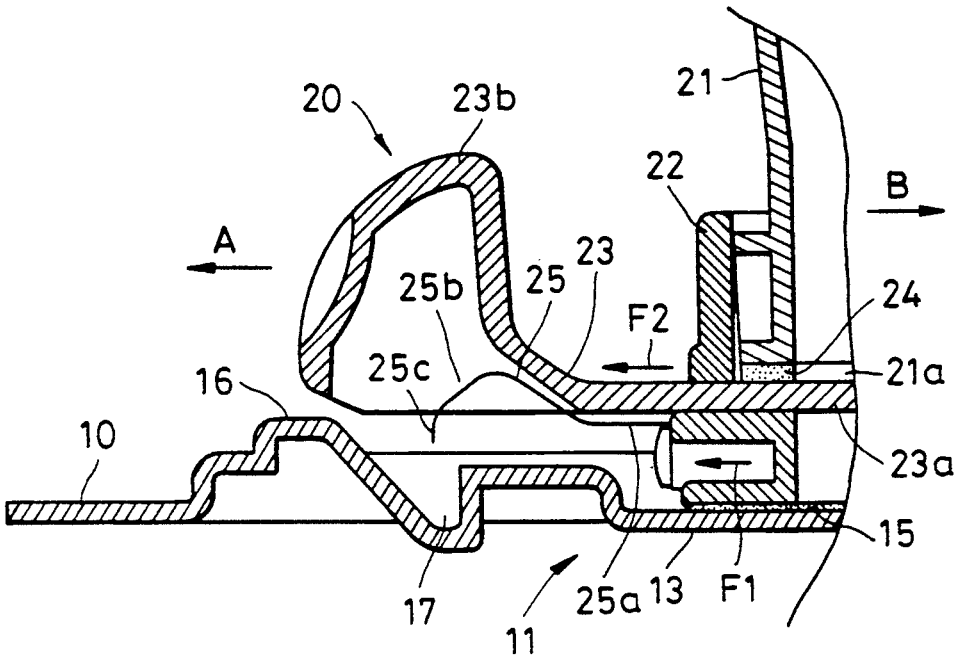
FIG. 6 is a partial cross-sectional view of the neighborhood of an openable cover of the developer supply container.

Next, an explanation will be provided of the detail of the neighborhood of the openable cover 23 of the developer supply container 20 mounted to the upper cover 10 of the hopper with reference to FIG. 6. In FIG. 6, the openable cover 23 comprises an openable portion 23*a* to open and close the opening 21*a* of the main body 21 of the container, and a grasping portion 23*b* which is always exposed to the outside and is curved in an upwardly convex manner. The openable portion 23*a* of the openable cover 23 slidably moves back and forth (in direction A or B) within a groove provided in an inner circumferential surface of the guide member 22 to open and close the opening 21*a* of the main body 21 of the container. A seal member 24 is disposed between the main body 21 of the container and the openable cover 23 in order to prevent toner from leaking outside around the openable cover 23 while the openable portion 23*a* '*slidably moves.*

The container mounting portion 11 of the upper cover 10 of the hopper comprises a protruding guide portion 16 for guiding and supporting the openable cover 23, which slidably moves and protrudes. At an outer side of its front portion, a groove portion 17 is disposed between the guide member 16 and the mounting member 13, and the like.

At a portion below the grasping portion 23*b* of the openable cover 23 is disposed an elastic pawl 25 made of an elastic material for regulating the sliding movement of the developer supply container 20 on the container mounting portion 11 of the upper cover 10 of the hopper.

The elastic pawl 25, serving as a lock member, comprises a horizontal portion 25*a* fixed to the guide member 22, an upwardly curved portion 25*b*, and an engaging portion 25*c* downwardly entering the groove portion 17 of the upper cover 10 of the hopper. In a closed state of the openable cover 23, the horizontal portion 25*a* and the upwardly inclining portion of the upwardly curved portion 25*b* adjoining the horizontal portion 25*a* are situated along the inner surfaces of the openable portion 23*a* and the grasping portion 23*b* of the openable cover 23.

Figure 7:
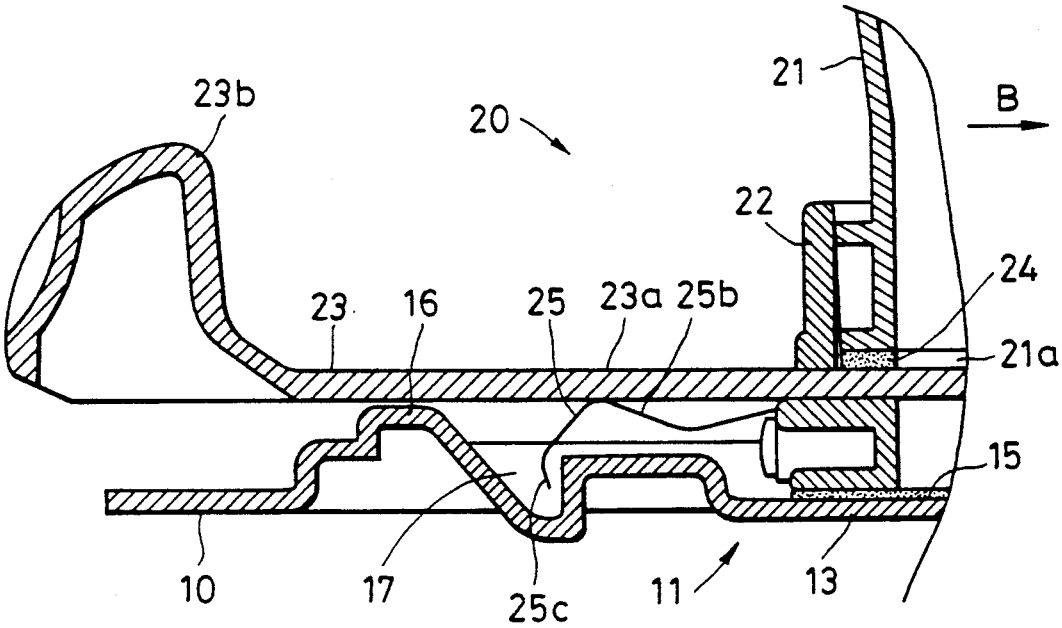
FIG. 7 is a diagram illustrating the function of the openable cover shown in FIG. 6.

As shown in FIG. 7, after the developer supply container 20 has been dropped in the mounting portion 11 of the upper cover 10 of the hopper and has been positioned by being slidably moved in the forward direction (direction A), if the openable cover 23 is opened by being slidably moved in the same direction, toner within the main body 21 of the container can be supplied to the toner hopper via the opening 12. In the state that the toner within the container 21 is supplied within the toner hopper by sliding the openable cover 23 in the forward direction (direction A), since the upwardly curved portion 25*b* of the elastic pawl 25 is downwardly pressed by the openable portion 23*a* of the openable cover 23, the engaging portion 25*c* is engaged within the groove portion 17 of the upper cover 10 of the hopper. Accordingly, since the developer supply container 20 cannot backwardly slide in direction B on the container mounting portion 11 of the upper cover 10 of the hopper in this state, the container 20 is fixed to the container mounting portion 11, and cannot be detached from the upper cover 10 of the hopper.

When all the toner within the main body 21 of the container has been supplied within the hopper, the openable cover 23 is closed. At that time, since the engaged state between the elastic pawl 25 and the groove portion 17 of the upper cover 10 of the hopper is not released until the openable cover 23 is completely closed, the developer supply container 20 cannot be detached from the upper cover 10 of the hopper.

Accordingly, in supplying toner to the toner hopper, the developer supply container 20 cannot be detached in an opened state of the openable cover 23, and it is therefore possible to prevent the scattering of the toner.

As described above, since the developer supply container 20 of the present embodiment is detached by being slidably moved on the container mounting portion 11 of the upper cover 10 of the hopper, the developer supply container 20 can be fixed to the side of the upper cover 10 of the hopper of the main body of the apparatus while its openable cover 23 is opened by the simple elastic pawl 25 functionally linked with an opened state of the openable cover 23.

As described above, when setting the developer supply container 20 to the mounting portion 11 of the upper cover 10 of the hopper, the developer supply container 20 is positioned on the container mounting portion 11 of the upper cover 10 of the hopper by dropping the developer supply container 20 in the mounting member 13 of the container mounting portion 11 of the upper cover 10 of the hopper and forwardly sliding the container 20 a predetermined amount. However, if the amount of the sliding movement of the developer supply container 20 is insufficient and the developer supply container 20 is therefore insufficiently positioned, the opening 21*a* of the developer supply container 20 is insufficiently superposed with the opening 12 of the container mounting portion 11. Hence, if the openable cover 23 is opened, the neighborhood of the opening 12 of the container mounting portion 11 is stained with toner. Furthermore, since the elastic pawl 25 cannot be sufficiently engaged with the groove portion 17 of the upper cover 10 of the hopper, the developer supply container 20 may be easily detached from the upper cover 10 of the hopper.

In the present invention, in order to solve the above-described problems, the device is arranged so that the openable cover 23 can be slidably opened only with a force F2 which is larger than a force F1 needed to slide the developer supply container 20 on the mounting member 13 of the container mounting portion 11.

That is, the seal member 24 for opening and closing the openable cover 23 which is thicker about 0.4 mm than the mounting gap of the seal member 24 is used. In openinq and closing the openable cover 23, the seal member 24 is deformed 0.4 mm to provide the force F2, of about 2.5–3.0 kgf, needed to open the openable cover 23. A seal member 15 which has a thickness of 0.2 mm more than the mounting gap of the seal member 15 is provided for sliding the developer supply container 20. In sliding the developer supply container 20, the seal member 15 is deformed 0.2 mm to provide the force F1 needed to slide the developer supply container 20 having a value of, for example, about 1.5–2.0 kgf. The seal members 15 and 24 are made of an identical elastic material which is extensible.

In dropping the developer supply container 20 in the mounting member 13 of the container mounting portion 11 of the upper cover 10 of the hopper and slidably moving the container 20 in the forward direction, even if the amount of the movement is insufficient and the developer supply container 20 is not correctly positioned on the container mounting portion 11, the developer supply container 20 is slid and correctly positioned on the container mounting portion 11 by the force to try to subsequently open the openable cover 23, and the openable cover 23 is subsequently opened.

Accordingly, even if the developer supply container 20 is not sufficiently positioned on the container mounting portion 11, the developer supply container 20 is correctly positioned by the opening operation of the openable cover 23. Hence, it is possible to solve various kinds of problems due to insufficient positioning of the developer supply container 20.

In the foregoing explanation, a difference between the force F1 needed to slide the developer supply container 20 and the force F2 needed to slide the openable cover 23 is provided utilizing the seal members 15 and 24. However, the method to provide a difference between the two forces is not limited to the above-described method, but a difference between the forces F1 and F2 may be provided by any other method so that the relationship of $F2 > F1$ is satisfied.

Figure 8:
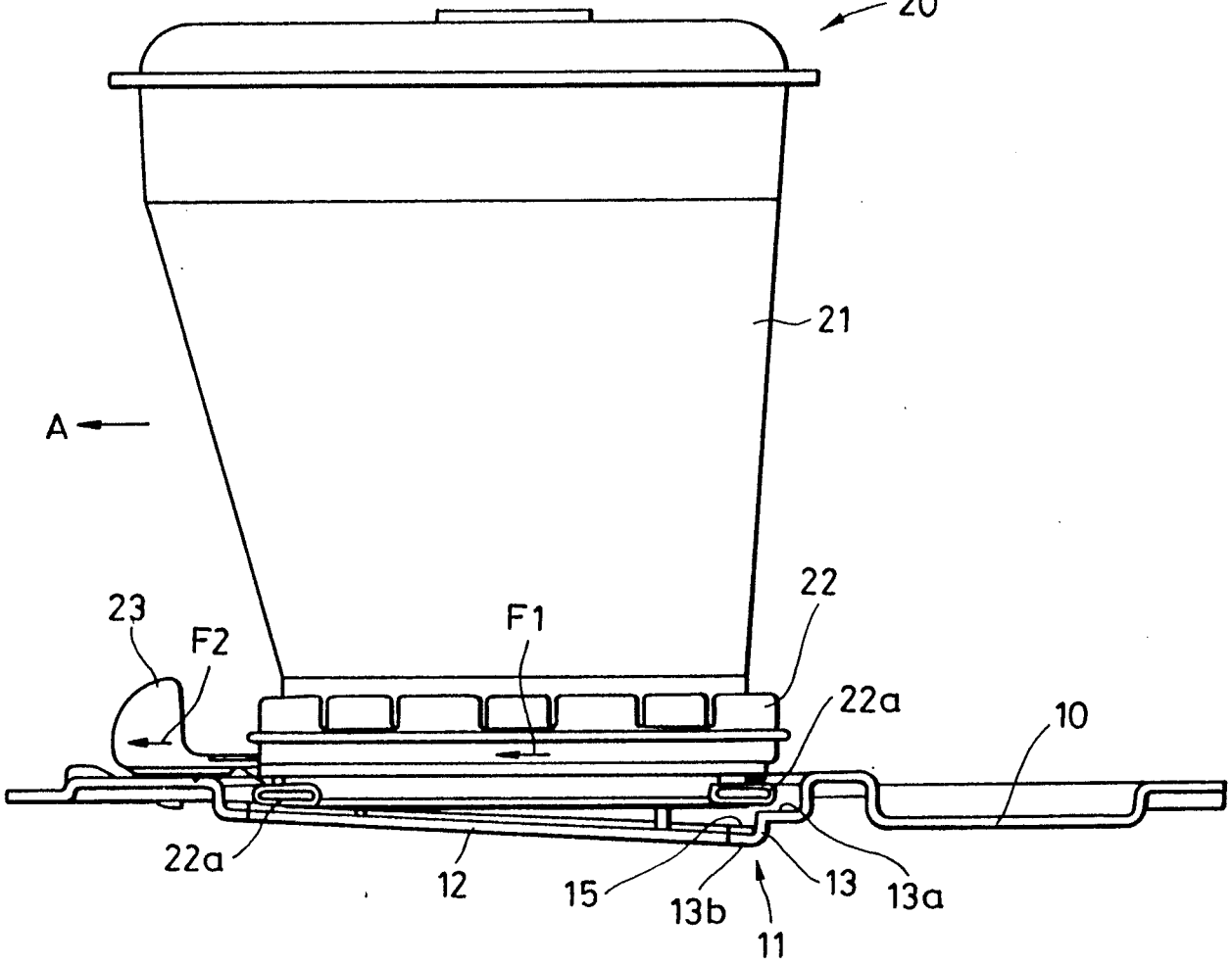
FIG. 8 is a cross-sectional view showing a state, wherein the developer supply container is dropped in a container mounting portion of an upper cover of a hopper according to another embodiment of the invention.

As shown in FIG. 8, a rear portion of the mounting member 13 of the container mounting portion 11 of the upper cover 10 of the hopper has two steps. First, the developer supply container 20 is dropped in an upper step 13*a* of the mounting member 13. Subsequently, after more or less sliding the developer supply container 20 in direction A, the developer supply container 20 is dropped in a lower step 13*b* of the mounting member 13 to position the developer supply container 20 on the container mounting portion 11. In this case also, by arranging so that the force F2 needed to open the openable cover 23 in direction A is larger than the force F1 needed to slide the developer supply container 20 on the upper step 13*a* of the mountinq member 13. The same effect as described above may be obtained.

Figure 9:
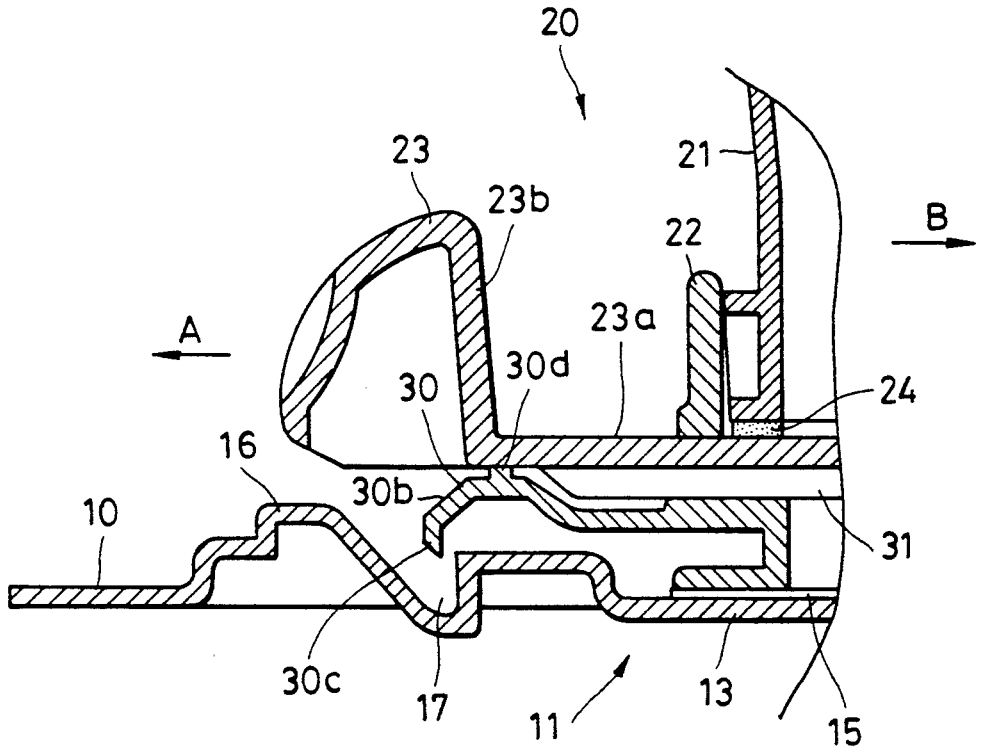
FIG. 9 is a partial cross-sectional view of the neighborhood of the openable cover of the developer supply container which adopts a second embodiment of an elastic pawl.

An explanation will now be provided of another embodiment of the above-described elastic pawl 25 with reference to FIG. 9. Components having the same functions as those in the above-described first embodiment are indicated by the same numerals, and an explanation thereof will be omitted.

In the second embodiment, an elastic pawl 30 having the same function as the elastic pawl 25 of the first embodiment is configured as one body with the guide member 22. In a closed state of the openable cover 23 shown in FIG. 9. A projection 30*d*, provided at an upper end of an upwardly curved portion 30*b* of the elastic pawl 30, contacts the lower surface of the openable portion 23*a* of the openable cover 23. A rib 31 protrudes on the lower surface of the openable portion 23*a* of the openable cover 23 at the side closer to the main body 21 of the container than the projection 30*d* of the elastic pawl 30. When the openable cover 23 is opened, the rib 31 downwardly presses the upwardly curved portion 30*b* of the elastic pawl 30 to engage portion 30*c* of the elastic pawl 30 with the groove portion 17 of the upper cover 10 of the hopper.

The developer supply container 20 may be detached from the container mounting portion 11 of the upper cover 10 of the hopper in the same manner as in the first embodiment, that is, by sliding the developer supply container 20 from the state shown in FIG. 1 a predetermined distance in the direction of arrow B.

If the openable cover 23 is slid in the outward and forward direction (direction A) in order to supply the toner hopper with toner, the elastic pawl 30 is downwardly pressed by the rib 31 of the openable cover 23, the engaging portion 30*c* at the front end of the elastic pawl 30 is engaged with the groove portion 17 of the upper cover 10 of the hopper, and the developer supply container 20 becomes incapable of being detached from the upper cover 10 of the hopper. If all the toner within the main body 21 of the container is supplied to the toner hopper, the openable cover 23 is closed. However, the developer supply container 20 cannot be detached from the upper cover 10 of the hopper until the openable cover 23 is completely closed, since the engaging portion 30*c* of the elastic pawl 30 is engaged with the groove portion 17 of the upper cover 10 of the hopper.

As described above, also in the present embodiment, the same effect as in the first embodiment may be obtained.

Figure 10:
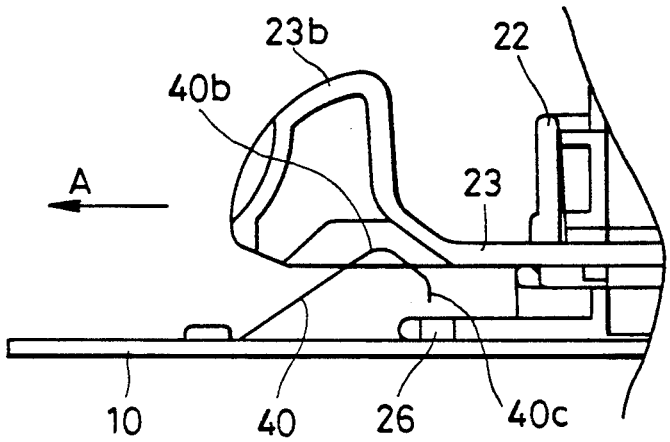
FIG. 10 is a partial cross-sectional view of the neighborhood of the openable cover of the developer supply container which adopts a third embodiment of an elastic pawl.
Figure 11:
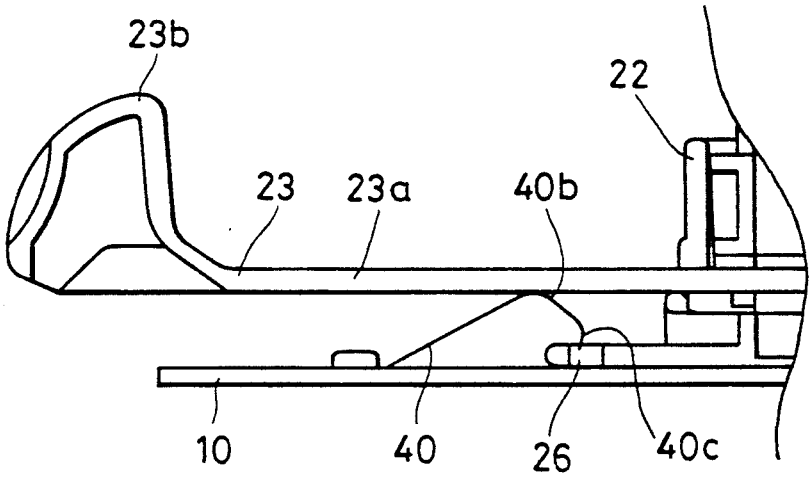
FIG. 11 is a diagram illustrating the function of the openable cover shown in FIG. 10.

An explanation will now be provided of a third embodiment of the elastic pawl with reference to FIGS. 10 and 11. Components having the same functions as those in the first and second embodiments are indicated by the same numerals, and an explanation thereof will be omitted.

In the present embodiment, an elastic pawl 40, which is the same as the elastic pawl of the first embodiment, is mounted on the upper cover 10 of the hopper of the main body of the container. A groove portion 26 for engaging an engaging portion 40*c* of the elastic pawl 40 is provided at a front protruded portion of the guide member 22 of the developer supply container 20.

A curved portion 40*b* of the elastic pawl 40 is situated below the grasping portion 23*b* of the openable cover 23 while the openable cover 23 is closed. As shown in FIG. 11, if the openable cover 23 is opened, even though slightly, in the forward direction A, the elastic pawl 40 is downwardly pressed by the openable portion 23*a* of the openable cover 23, and the enagaging portion 40*c* is engaged with the groove portion 26 of the guide member 22. Hence, the developer supply container 20 cannot slidably move on the upper cover 10 of the hopper.

Accordingly, if the device is arranged so that the developer supply container 20 is slidably detached from the upper cover 10 of the hopper as in the first and second embodiments, the same effects as in the first and second embodiments may also be obtained in the present embodiment.

An explanation will now be provided of a developer supply device according to another embodiment of the present invention.

Recently, image forming apparatuses have been diversified, and various kinds of toner having different colors, different charging polarities, different particle sizes and the like have been used. If these different kinds of toner are received in a plurality of developer supply containers having a same shape to be supplied to corresponding image forming apparatuses, a case may arise wherein wrong toner is erroneously supplied to an image forming apparatus.

In order to prevent such accident, it is necessary to provide different kinds of developer supply containers in accordance the kinds of toner, so that an incorrect developer supply container is not erroneously mounted on an image forming apparatus.

The present embodiment provides a developer supply device which can securely supply a predetermined image forming apparatus with necessary toner without causing such misopèration.

Figure 12:
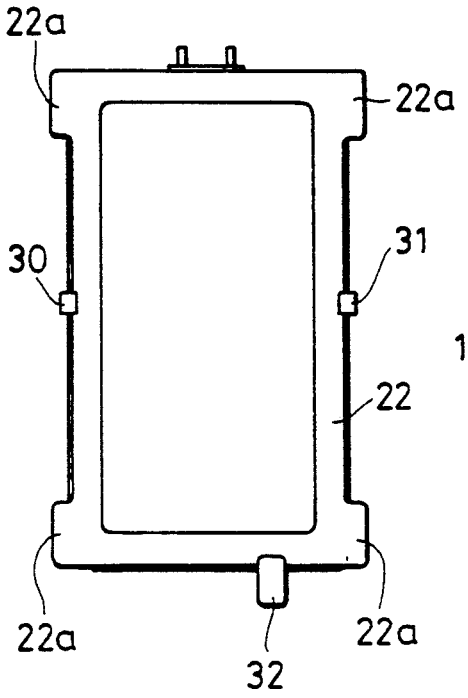
FIG. 12 is a plan view showing another embodiment of a guide member of a developer supply container.
Figure 14:
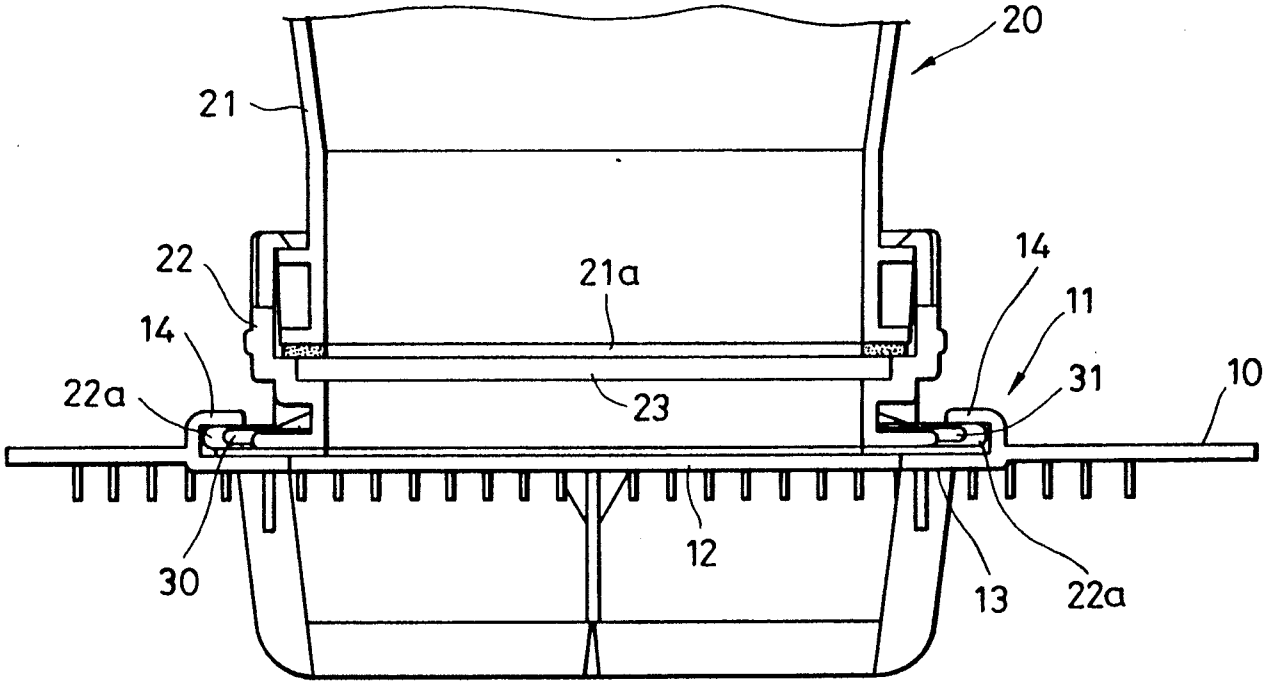
FIG. 14 is a perspective view showing a state, wherein the developer supply container having the guide member shown in FIG. 12 is mounted on the container mounting portion of the upper cover of the hopper shown in FIG. 13.

That is, in the present embodiment, projections 30, 31 and 32 for detecting the kinds of toner within the developer supply container 20 are provided at three surfaces, i.e. left, right and rear surfaces, of the guide member 22, serving as a member of the developer supply container 20 for dropping the container 20 in the container mounting portion 11 of the upper cover 10 of the hopper. That is, as shown in FIGS. 12 and 14, the left and right projections 30 and 31 for detection are provided between the positioning projections 22*a* of the guide member 22 at the same height as the positioning projections 22*a*. The rear projection 32 for detection is provided at a rear surface of the guide member 22, and the grasping portion 23*a* of the openable cover 23 is not protruded at the same height as the left and right projections 30 and 31 for detection.

Figure 13:
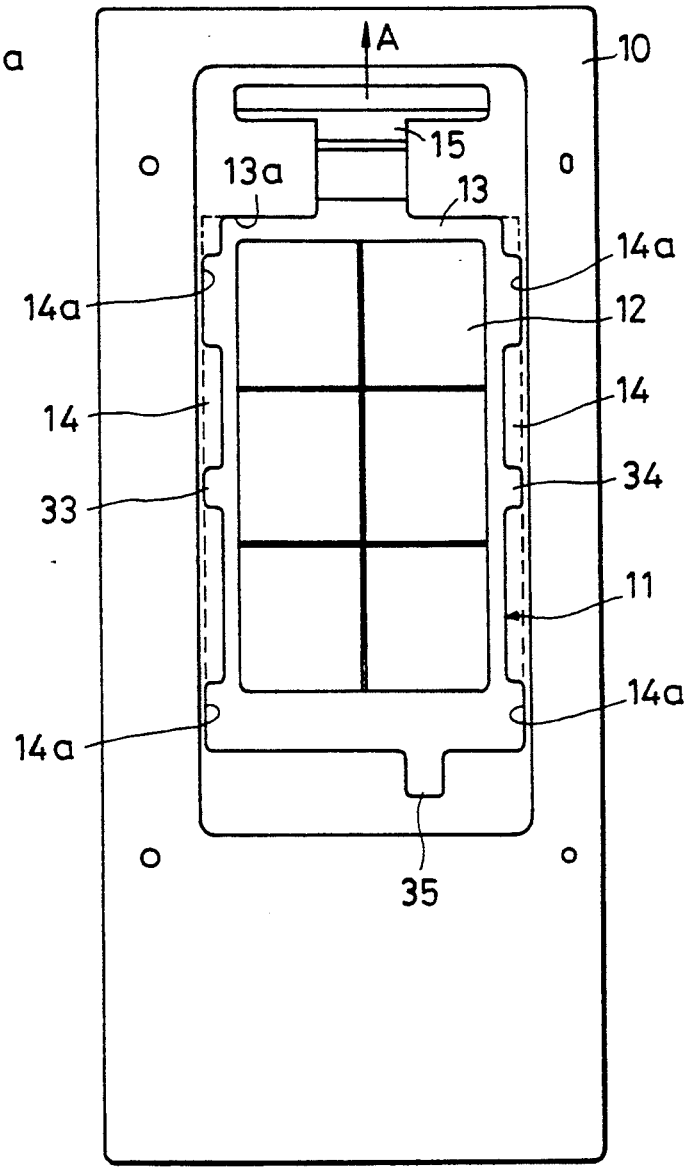
FIG. 13 is a plan view showing another embodiment of the container mounting portion of the upper cover of the hopper.

As shown in FIG. 13, corresponding to the above-described projections 30, 31 and 32 for detection of the developer supply container 20, recesses 33, 34 and 35 for detection are also provided at the left and right guide members 14, 14 and a rear portion side of the mounting member 13 of the mounting portion 11 of the upper cover 10 of the hopper.

When mounting the developer supply container 20 receiving necessary toner on the container mounting portion 11 of the upper cover 10 of the hopper, the developer supply container 20 can be exactly dropped in the mounting member 13 of the container mounting portion 11, since the positions of the projections 30, 31 and 32 for detection of the developer supply container 20 coincide with the positions of the recesses 33, 34 and 35 for detection of the upper cover 10 of the hopper. Subsequently, it is possible to slide the developer supply container 20 relative to the mounting member 13 to position the developer supply container 20, and to exactly supply toner received in the container 20 within the toner hopper.

In the case of a developer supply container 20 receiving toner different from that to be used, however, if the projections 30, 31 and 32 for detection of the developer supply container 20 have been changed, their positions and sizes do not coincide with the positions and sizes of the recesses 33, 34 and 35 of the upper cover 10 of the hopper at all. Hence, even if it is tried to mount the developer supply container 20 on the container mounting portion 11 of the upper cover 10 of the hopper and if some of the projections 30, 31 and 32 are deleted, the hopper cannot be dropped in the mounting member 13. Accordingly, any engaging relationship does not arise between the developer supply container 20 and the container mounting portion 11 of the upper cover 10 of the hopper, and the openable cover 23 of the developer supply container 20 will never be erroneously opened.

That is, it is possible to properly mount the correct developer supply container 20 on the container mounting portion 11, and to correctly supply toner without an error.

When the above-described projections for detection are provided only on two surfaces or one surface of the guide member 22 of the developer supply container 20, if another developer supply container 20 is erroneously mounted on the container mounting portion 11 of the upper cover 10 of the hopper, part of the developer supply container 20 is dropped in the mounting member 13 of the container mounting portion 11, and some kind of engaging relationship arises between the developer supply container 20 and the container mounting portion 11. As a result, it becomes impossible to slidably open the openable cover 23, and the wrong toner is supplied within the toner hopper. Furthermore, since the opening 21*a* of the developer supply container 20 is not sufficiently superposed with the opening 12 of the container mounting portion 11, toner within the developer supply container 20 adheres to the upper cover 10 of the hopper, staining the neighborhood.

Figure 15:
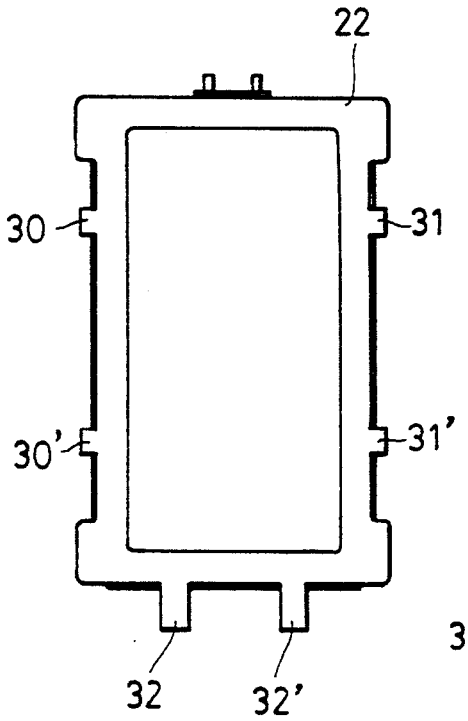
FIGS. 15 and 17 are plan views showing still another embodiments of the guide member of the developer supply container.
Figure 16:
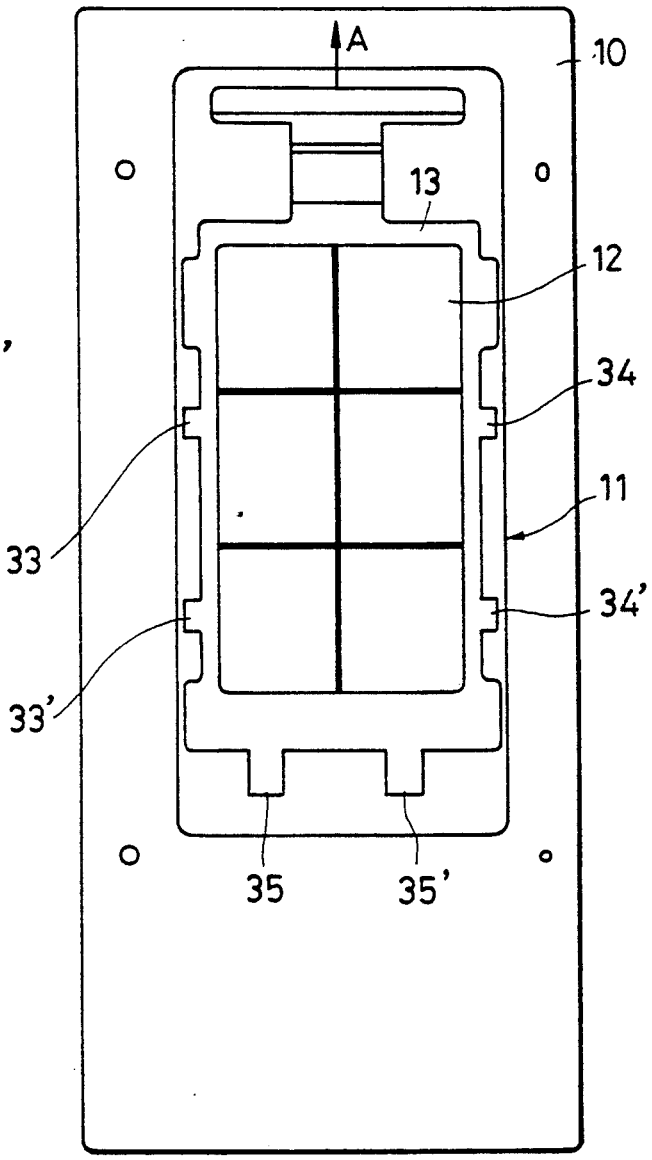
FIGS. 16 and 18 are plan views showing still another embodiments of the container mounting portion of the upper cover of the hopper.

Although, in the foregoing explanation, the projections 30, 31 and 32 for detection have been provided at three respective surfaces of the developer supply container 20 to be dropped in the container mounting portion 11, and the three recesses 33, 34 and 35 for detection have also been provided at the container mounting portion 11 corresponding to the projections 30, 31 and 32, two or more projections 30 and 30', 31 and 31', and 32 and 32' for detection may be provided on respective surfaces of the developer supply container 20, and recesses 33 and 33', 34 and 34', and 35 and 35' for detection may be provided at the mounting portion 11 corresponding to the respective projections, as shown in FIGS. 15 and 16.

Figure 17:
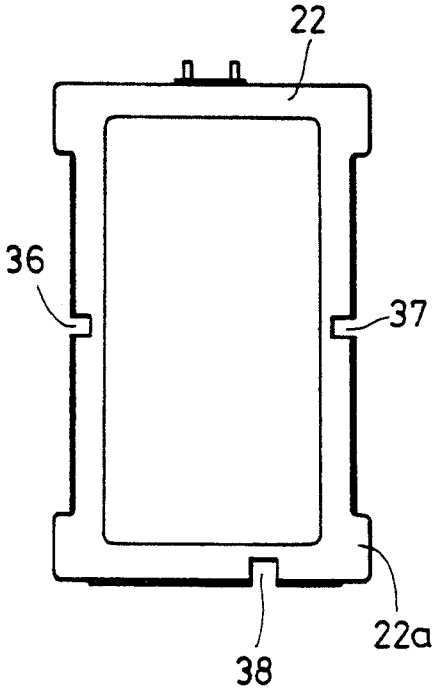
Figure 18:
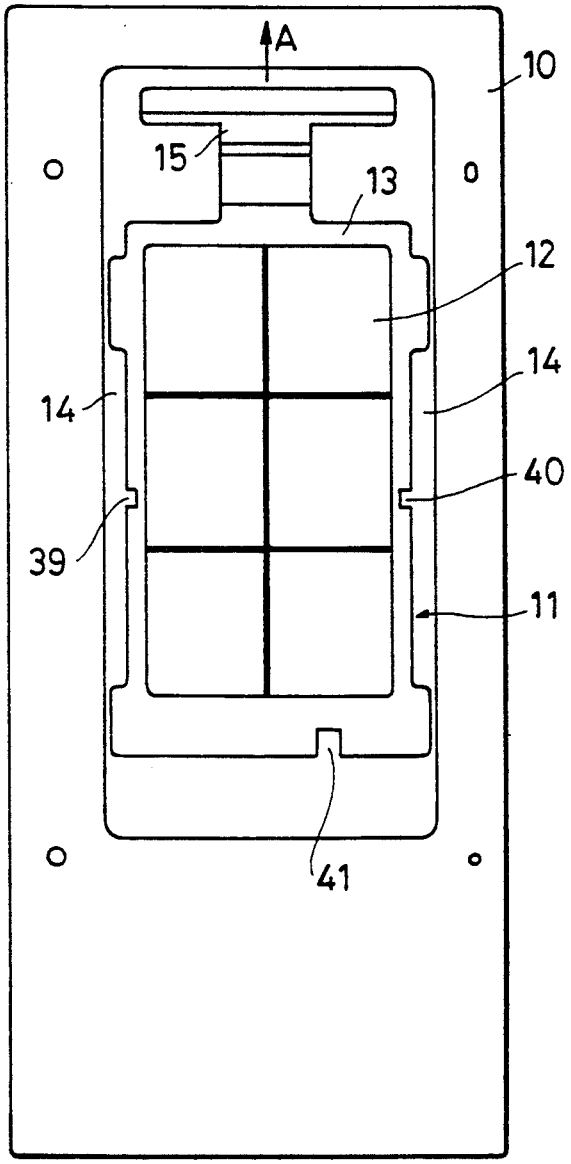

Furthermore, as shown in FIGS. 17 and 18, recesses 36, 37 and 38 for detection may be provided at the developer supply container 20, and projections 39, 40 and 41 may be provided at the container mounting portion 11. In addition, projections and recesses may be appropriately combined at the developer supply container 20 and the container mounting portion 11.

Although an explanation has been provided of the developer supply container 20 having a rectangular cross section orthogonal to the direction to drop the container 20, the cross section is not limited to a rectangle, but the above-described concept may be applied for any container having a polygonal cross section, such as a triangle, a pentagon, or the like.

As explained above, according to the present invention, since the force to open the slidably openable member of the developer supply device is arranged to be larger than the force to slide the developer supply container to a predetermined position, the developer supply container is always exactly positioned at the predetermined position when the slidably openable member is opened. It is thereby possible to correctly supply a developer by opening the openable member.

Furthermore, in the present invention, since the member to regulate the sliding movement of the developer supply container is provided, the developer supply container can be fixed to the main body of the apparatus while the openable member is opened. Hence, in supplying a developer from the developer supply container, the developer is not scattered from the developer supply container.

Moreover, according to the present invention, by devising the engaging portions between the developer supply container and the mounting member for the container, a developer supply container for a different kind of developer cannot be erroneously mounted, and only a proper developer supply container can be selected. Hence, it is possible to always supply a proper developer.

What is claimed is:

1. A developer supply container detachably mountable on a mounting portion of an image forming apparatus, said container comprising:

a main body accommodating a developer, and having an opening for supplying the developer to the image forming apparatus;

a slide cover for opening and closing said opening, said cover being movable relative to the main body in a first direction to open said opening, and being movable relative to the main body in a second direction opposite the first direction to close said opening;

a slide member engageable with guide means provided at the mounting portion of the image forming apparatus, for guiding a slide movement of the container in the first direction to set the container at a predetermined position for supplying the developer to the image forming apparatus, and for guiding a slide movement of the container in the second direction from the predetermined position; and a stopper engaging member for engaging a stopper provided at the mounting portion of the image forming apparatus, for preventing the container from moving in the first direction when the container is set at the predetermined position;

wherein a force required to move said slide cover in the first direction to open said opening is larger than a force required to move said container including said slide cover in the first direction to the predetermined position.

2. A container according to claim 1, wherein, when the container is set at the predetermined position, said opening is facing down.

3. A container according to claim 2, wherein said opening faces an orifice of the image forming apparatus when the container is set at the predetermined position.

4. A container according to any one of claims 1 to 3, further comprising a member for selectively prohibiting a slide movement of the container in the second direction, said prohibiting member being movable between an operable position and an inoperable position in response to movement of said cover, wherein said prohibiting member is moved to the operable position when the container is set at the predetermined position and said cover is moved in the first direction to open said opening, and wherein said prohibiting member engages an engaging portion provided at the mounting portion of the image forming apparatus and prohibits a slide movement of the container from the predetermined position in the second direction when said prohibiting member is in the operable position.

5. A container according to any one of claims 1 to 3, wherein said cover is arranged to engage and move a prohibiting member provided at the mounting portion of the image forming apparatus, the prohibiting member being movable between an operable position and an inoperable position in response to movement of said cover, wherein the prohibiting member is moved to the operable position when the container is set at the predetermined position and said cover is moved to open said opening, and wherein the container further comprises an engaging member for engaging the prohibiting member so that, when the prohibiting member is in the operable position, the prohibiting member prohibits the container from moving in the second direction from the predetermined position.

6. A developer supply container detachably mountable on a mounting portion of an image forming apparatus, said container comprising:

a main body accommodating a developer, and having an opening for supplying the developer to the image forming apparatus;

a slide cover for opening and closing said opening, said cover being movable relative to the main body in a first direction to open said opening, and being movable relative to the main body in a second direction opposite the first direction to close said opening;

a slide member engagable with guide means provided at the mounting portion of the image forming apparatus, for guiding a slide movement of the container in the first direction to set the container at a predetermined position for supplying the developer to the image forming apparatus, and for guiding a slide movement of the container in the second direction from the predetermined position; and a prohibiting member for prohibiting a slide movement of the container in the second direction, said prohibiting member being movable between an operable position, in which said prohibiting member engages an engaging portion provided at the mounting portion of the image forming apparatus, and an inoperable position, in which said prohibiting member does not engage said engaging portion, in response to movement of said cover, wherein said prohibiting member is moved to the operable position when the container is set at the predetermined position and said cover is moved to open said opening, and wherein said prohibiting member prohibits a slide movement of the container from the predetermined position in the second direction when said prohibiting member is in the operable position.

7. A container according to claim 6, wherein said prohibiting member is elastically biased in a direction from the operable position to the inoperable position, and wherein said prohibiting member is moved to the operable position when pressed by said cover.

8. A container according to claim 6 or 7 further comprising a stopper engaging member for engaging a stopper provided at the mounting portion of the image forming apparatus, for preventing said container from moving in the first direction when the container is ln the predetermined position.

9. A container according to claim 8, wherein, when said container is set at the predetermined position, said opening is facing down.

10. A container according to claim 9, wherein said opening faces an orifice of the image forming apparatus when the container is set at the predetermined position.

11. A developer supply container detachably mountable on a mounting portion of an image forming apparatus, said container comprising:

a main body accommodating a developer, and having an opening for supplying the developer to the image forming apparatus;

a slide cover for opening and closing said opening, said cover being movable relative to the main body in a first direction to open said opening, and being movable relative to the main body in a second direction opposite the first direction to close said opening;

a slide member engagable with guide means provided at the mounting portion of the image forming apparatus, for guiding a slide movement of the container in the first direction to set the container at a predetermined position for supplying the developer to the image forming apparatus, and for guiding a slide movement of the container in the second direction from the predetermined position; and an engaging member for engaging a prohibiting member provided at the mounting portion of the image forming apparatus, wherein said prohibiting member is movable between an operable position and an inoperable position in response to movement of said cover, wherein, when the prohibiting member is in the operable position, the prohibiting member engages said engaging member and prohibits the container from moving in the second direction from the predetermined position, and wherein said prohibiting member is moved to the operable position when the container is set at the predetermined position and said cover is moved to open said opening.

12. A container according to claim 11, further comprising a stopper engaging member for engaging a stopper provided at the mounting portion of the image forming apparatus, for preventing the container from moving in the first direction when the container is set at the predetermined positioned.

13. A container according to claims 11 or 12, wherein said cover moves the prohibiting member to the operable position by pushing the prohibiting member.

14. A container according to claim 13, wherein, when the container is set at the predetermined position, said opening is facing down.

15. A container according to claim 14, wherein said opening faces an orifice of the image forming apparatus when the container is set at the predetermined position.

* * * * *

UNITED STATES PATENT AND TRADEMARK OFFICE

CERTIFICATE OF CORRECTION

PATENT NO. : 5,268,722

DATED : December 7, 1993

INVENTOR(S) : MASATOSHI IKKATAI, ET AL.

It is certified that error appears in the above-indentified patent and that said Letters Patent is hereby corrected as shown below:

In The Abstract, at 57:
line 3, "accomodating" should read --accommodating--;
line 6, "accomodating" should read --accommodating--;
line 13, "accomodating" should read --accommodating--;
line 15, "accomodating" should read --accommodating--;
line 18, "accomodating" should read --accommodating--;
and line 19, "accomodat-" should read --accommodat---.

COLUMN 1
line 14, "accomodating" should read --accommodating--.

COLUMN 2
line 5, "prevent" should read --prevents--;
line 13, "comodating" should read --commodating--;
line 23, "athe" should read --the--; and
line 36, "accommodating" should read --accommodating--.

COLUMN 3
line 26, "another" should read --other--;
line 29, "another" should read --other--; and
line 38, "accomodating" should read --accommodating--.

COLUMN 4
line 20, "cover 11" should read --cover 10--; and
line 48, italics should be deleted.

COLUMN 6
line 10, "opening" should read --opening--; and
line 63, "member 13, The" should read --member 13, the--.

UNITED STATES PATENT AND TRADEMARK OFFICE

CERTIFICATE OF CORRECTION

PATENT NO. : 5,268,722

DATED : December 7, 1993

INVENTOR(S) : MASATOSHI IKKATAI, ET AL.

It is certified that error appears in the above-indentified patent and that said Letters Patent is hereby corrected as shown below:

COLUMN 7
line 7, "FIG. 9.a" should read -- FIG. 9, a--.

COLUMN 8
line 31, "i.e. left" should read --i.e., left,--.

COLUMN 10
line 13, "divising", should read --dividing--.

COLUMN 12
line 1, "further" should read --7, further--; and
line 52, "positioned." should read --position.--.

Signed and Sealed this

Twentieth Day of September, 1994

Bruce Lehman

*Attest:*

BRUCE LEHMAN

*Attesting Officer*

*Commissioner of Patents and Trademarks*